US011247818B1

(12) United States Patent
Lewandowski et al.

(10) Patent No.: US 11,247,818 B1
(45) Date of Patent: Feb. 15, 2022

(54) LID FOR CONTAINERS, PARTICULARLY BEVERAGE CONTAINERS

(71) Applicant: Reend Spolka z Ograniczona Odpowiedzialnoscia, Krzemieniewo (PL)

(72) Inventors: Dariusz Lewandowski, Warsaw (PL); Roman Sobecki, Gostyn (PL)

(73) Assignee: Reend Spolka z Ograniczona Odpowiedzialnoscia, Krzemieniewo (PL)

( * ) Notice: Subject to any disclaimer, the term of this patent is extended or adjusted under 35 U.S.C. 154(b) by 0 days.

(21) Appl. No.: 17/496,577

(22) Filed: Oct. 7, 2021

Related U.S. Application Data

(63) Continuation of application No. PCT/PL2019/000057, filed on Aug. 1, 2019.

(51) Int. Cl.
*B65D 47/28* (2006.01)

(52) U.S. Cl.
CPC ..... *B65D 47/28* (2013.01)

(58) Field of Classification Search
CPC ..... B65D 47/26; B65D 47/28
See application file for complete search history.

(56) References Cited

U.S. PATENT DOCUMENTS 1,836,561 A * 12/1931 Van Valkenburg .... B65D 47/26 222/80
2,018,033 A * 10/1935 Rickerd ..... B65D 47/28 222/559
2,139,085 A 12/1938 Lawson
2,255,225 A * 9/1941 Meggy ..... B65D 47/286 222/192
2,480,733 A * 8/1949 Louis ..... B65D 47/28 222/560
6,299,036 B1 * 10/2001 Fuchs ..... B65D 47/24 222/509
6,354,454 B1 * 3/2002 Wong ..... B65D 47/263 215/322

FOREIGN PATENT DOCUMENTS

WO 2010094793 A2 8/2010
WO 2014003586 A2 1/2014

* cited by examiner

*Primary Examiner* — Donnell A Long
(74) *Attorney, Agent, or Firm* — Myers Wolin, LLC

(57) ABSTRACT

A lid of a container, particularly beverage container, comprising an opening for emptying the container, fitted with guides formed on two opposite walls and with a slide piece for opening and reclosing the said opening, where there are two catches formed on the top surface of the slide piece, the catches fitted slidingly in the opening on the said guides, and where the slide piece is fitted with technical means for shifting the slide piece from the closed position to the open position and backwards, is characterised in that the surfaces (2*a*) of the catches (2) of the slide piece (1) which cooperate with the guides (4) are inclined at an acute angle (α) with respect to the top surface of the slide piece (1) positioned under the said surfaces (2*a*) of the catches (2).

20 Claims, 24 Drawing Sheets

LID FOR CONTAINERS, PARTICULARLY BEVERAGE CONTAINERS

CROSS REFERENCE TO RELATED APPLICATIONS

This application is a continuation under 35 U.S.C. § 120 of International Application PCT/PL2019/000057, filed Aug. 1, 2019, which claims priority to Polish Application P.429610, filed Apr. 11, 2019, the contents of each of which are incorporated by reference herein.

FIELD OF THE INVENTION

The invention concerns a lid for containers, particularly beverage containers. The lid is suitable for containers of any structure, in particular containers made of plastic, metal cans, and carton containers.

BACKGROUND

Known from patent document WO 2010/094793 A2 is a container lid, particularly of a beverage can, incorporating a reclosing mechanism of elastic material, fixed entirely to the bottom side of the cover and partially integrated therewith in a way which prevents its twisting, featuring an actuating mechanism fitted on the top side of the lid via an adapter. When the actuating mechanism is moved, the part of the reclosing mechanism which covers the opening swivels in the plane perpendicular to the surface of the lid. The opening can be reclosed by moving the actuating mechanism.

Known from patent document WO 2014/003586 A2 is a reclosing mechanism for containers, particularly beverage containers, incorporating means for opening and reclosing the beverage outflow opening in the form of a latch fitted slidingly on the guides, where the latch touches on the bottom surface of the lid around the opening. On the top, the lid is fitted with a sliding pull tab on one side connected to the latch via a hinge and on the other connected to the latch via a connector which serves as the seal before the first opening, where on the side of the hinge and the pull tab front the lid features respective resistance surfaces which determine the initial position of the latch before the first opening.

SUMMARY

The purpose of the invention is to develop a mechanism to open and reclose the opening for emptying a container, particularly a container for beverages, including carbonated beverages saturated with $CO_2$, which would ensure tight reclosing of the opening. In particular, the purpose of the invention is to develop the geometry of the opening in the container lid, and the geometry of the slide piece fitted in the opening and intended to open and close the opening, which would enable reduction of the friction between the slide piece and the lid surface when uncovering the opening, and achieving an optimal flow of the liquid through the opening.

A lid of a container, particularly beverage container, having an opening for emptying the container, fitted with guides formed on two opposite walls and with a slide piece for opening and reclosing the said opening, where there are two catches formed on the top surface of the slide piece, the catches fitted slidingly in the opening on the said guides, and where the slide piece is fitted with technical means adapted for shifting the slide piece from the closed position to the open position and backwards, according to the invention is characterised in that the surfaces of the slide piece catches which cooperate with the guides are inclined at an acute angle with respect to the top surface of the slide piece positioned under the said catch surfaces, with the slope in the direction in which the slide piece shifts to the open position, and where formed on the bottom side of the lid around the opening is a socket for the slide piece with profiled surfaces to seal the slide piece when in the socket in the closed position formed around its circumference, the socket touching on the profile of the surfaces around the slide piece, and where in the process of uncovering the opening the slide piece is moved downwards with respect to the socket.

Preferably, the width of the slide piece increases in the direction in which the slide piece moves to the open position.

Preferably, the angle of inclination of the surfaces of the slide piece catches with respect to the top surface of the slide piece positioned under the said surfaces of the catches ranges from 5° to 30°, preferably from 10° to 20°.

Preferably, formed on the top surface of the slide piece is at least one longitudinal distancing element and a transverse distancing profile element, and formed on the bottom side of the lid behind the slide piece socket is at least one longitudinal distancing element and a transverse distancing element formed along the transverse back wall of the opening.

Preferably, the profile surfaces which seal the slide piece in its socket are positioned on opposite sides along the socket, and the surfaces matching them, positioned on opposite sides along the slide piece open out towards the bottom.

In the first embodiment of the invention the technical means adapted for shifting the slide piece from the closed position to the open position and backwards take the form of a slider fitted on the top side of the lid over the opening, the slider having the top surface with a profile element to actuate the slider formed thereon, and further having the bottom surface and longitudinal side surfaces, where formed on the top surface of the slide piece and correspondingly on the bottom surface of the slider is at least one pair of mutually coupling elements, and where the lid is fitted with a cap featuring an opening positioned over the opening in the lid.

Preferably, a transverse groove and transverse projection placed in the said groove constitute the pair of mutually coupling elements formed on the top surface of the slide piece and correspondingly on the bottom surface of the slider.

Preferably, formed on the longitudinal side surfaces of the slider is a pair of resilient resistance elements, where on the top surface of the lid and/or bottom surface of the cap there are resistance elements which cooperate with the said resilient resistance elements of the slider.

In the second embodiment of the invention the technical means adapted for shifting the slide piece from the closed position to the open position and backwards take the form of a swivel tab with vertical axis of rotation, fitted on the top surface of the lid over the opening, where the slide piece has the top surface with a profile element for actuating the swivel tab formed thereon, the bottom surface, and the circumferential side surface, and where the shape of the circumferential side surface of the swivel tab on one side of the profile element is designed to close the opening, while the shape of the circumferential side surface of the swivel tab on the other side of the profile element is designed to uncover the opening, whereas formed on the top surface of the slide piece and correspondingly on the bottom surface of the swivel tab is a pair of mutually cooperating elements, with one of them taking the form of a driving pin and the other of a guiding groove in which the said driving pin moves during the swivel of the swivel tab, thus actuating the movement of the slide piece, where in the closed position the swivel tab touches on the opening in the lid with the element having the side circumferential surface which closes the opening, while in the open position the swivel tab touches on the opening with the element having the side circumferential surface which uncovers the opening, and where the lid is fitted with a cap featuring an opening positioned over the opening in the lid.

Preferably, the vertical axis of rotation of the swivel tab is placed on one of the sides of the plane of symmetry delimited in between the guides formed on two opposite walls of the opening.

Preferably, formed on the side circumferential surface of the swivel tab is a resistance element which cooperates with the resistance element formed on the top surface of the lid or on the bottom surface of the cap, where at least one of those elements is resilient.

In the third embodiment of the invention the technical means adapted to shift the slide piece from the closed position to the open position and backwards take the form of a pull tab having the bottom surface with a resistance projection formed thereon, two longitudinal side surfaces, formed on which is a pair of opposite side projections with arched edges, and a side transverse front surface on one end of the pull tab, where formed on the top surface of the slide piece and correspondingly on the bottom surface of the pull tab is at least one pair of mutually coupling elements, and formed on the side longitudinal walls of the opening in the lid are two sockets with the said side projections of the pull tab rotatingly fitted therein, and where in the closed position the side transverse front surface on the one end of the pull tab touches on the transverse front wall of the opening, and the other end of the pull tab rests on the lid, with the said resistance projection in the pull tab resting on the opposite transverse back wall of the opening.

Preferably, a transverse groove and transverse projection placed in the said groove constitute the pair of mutually coupling elements formed on the top surface of the slide piece and correspondingly on the bottom surface of the pull tab.

The lid is fitted with a cap featuring an opening positioned over the opening in the lid, and a resistance element positioned on the transverse back wall of the opening.

In the fourth embodiment of the invention the technical means adapted for shifting the slide piece take the form of a pull tab having the top surface with a top transverse edge, and the bottom surface with a projection and a bottom transverse edge, where in the closed position the top transverse edge of the pull tab touches on the transverse front wall of the opening and the said projection of the pull tab rests on the opposite transverse back wall of the opening, and where the pull tab is rotatingly connected to the slide piece with its bottom surface, on the side of the said bottom edge.

Preferably, formed on the top surface of the slide piece is a protruding element, connected to which via a membrane hinge is the bottom edge of the pull tab surface, and preferably there are niches formed between the catches and the protruding element to which the pull tab is connected, where the lid is fitted with a cap with the opening positioned over the opening in the lid, and formed on the bottom side of the cap there are projections placed in the said niches, or preferably there is at least one transverse rod formed on the top surface of the slide piece in between the catches, and formed on the bottom surface of the pull tab there is at least one arm ending with a socket, the arm rotatingly fitted on the said rod.

Preferably, the circumferential profiled surfaces of the socket, touching on which are the circumferential profiled surfaces of the slide piece and/or the said circumferential profiled surfaces of the slide piece, are fitted with a sealing element.

Preferably, the lid is made of plastic.

The mechanism for closing and uncovering the opening in the lid according to the invention attains the assumed goals. Thanks to the inclination of the surfaces of the slide piece catches which cooperate with the guides in the opening at an acute angle with respect to the top surface of the slide piece positioned under the said surfaces of the catches, with the slope in the direction in which the slide piece shifts to the open position, the slide piece gets immediately moved away from the socket in the lid once the movement of the slide piece in the opening uncovering direction is initiated, which eliminates the friction between the slide piece and the socket. The tight fitting of the slide piece in the socket achieved by the mutually matching profile elements formed on the circumferences of the slide piece and the socket ensures the required tightness, resistance to high pressure inside the container up to 7 bar, and airtightness of the closing device before the first opening, thanks to which the solution can be used for pressurised and highly carbonated beverages. In addition, the solution according to the invention proves highly intuitive and ergonomic when uncovering and closing the opening.

All elements of the lid can be made of the same material as the container, which is important from the perspective of recycling the used packaging.

The lid according to the invention is suitable for containers of various shapes, including cartons, and can be made using the existing methods of moulding and assembling.

BRIEF DESCRIPTION OF THE DRAWING

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
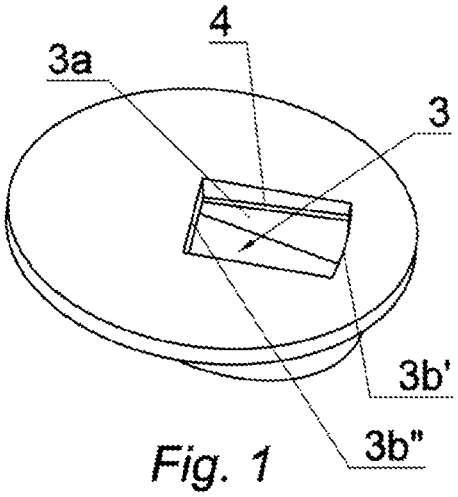
FIG. 1—shows the lid without the slide piece, in spatial view from the top.
Figure 2:
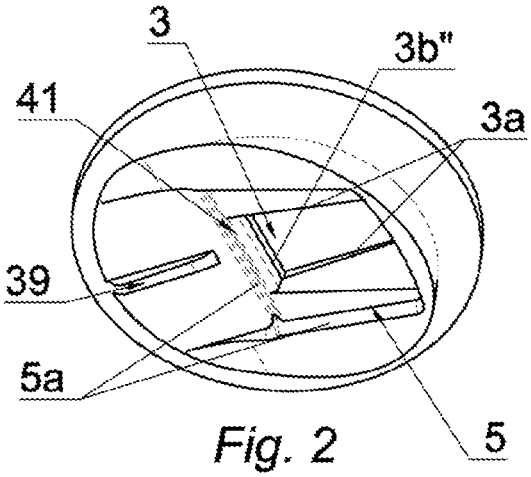
FIG. 2—depicts the lid without the slide piece, in spatial view from the bottom.
Figure 3:
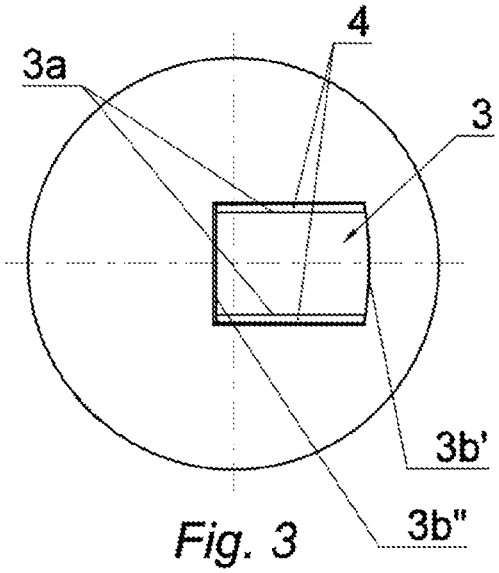
FIG. 3—presents the lid without the slide piece, in rectangular projection from the top.
Figure 4:
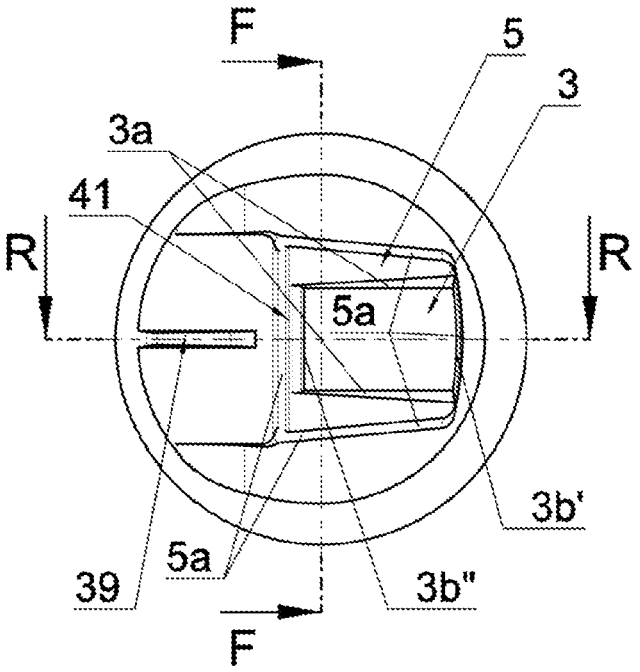
FIG. 4—shows the lid without the slide piece, in rectangular projection from the bottom.
Figure 5:
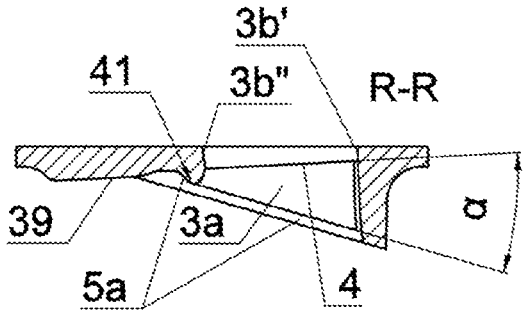
FIG. 5—depicts the lid without the slide piece, as in FIG. 4, in cross section along the R-R line.
Figure 6:
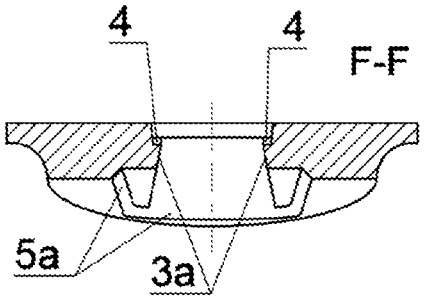
FIG. 6—presents the lid without the slide piece, as in FIG. 4, in cross section along the F-F line.
Figure 7:
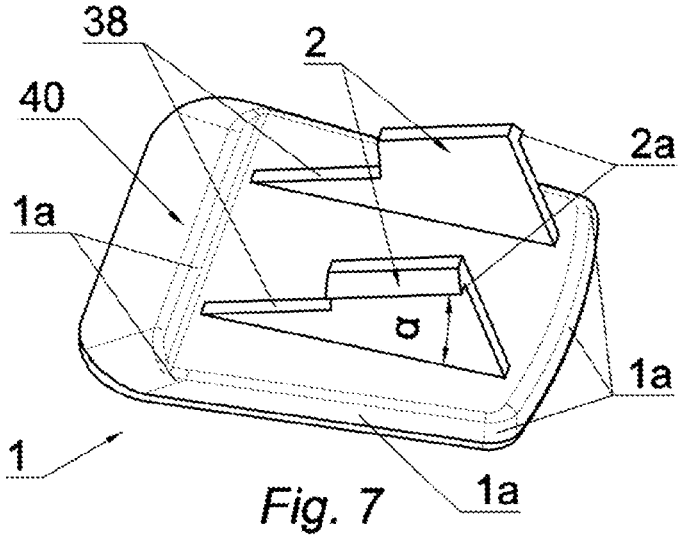
FIG. 7—depicts the slide piece, in spatial view from the top with the catches visible, without the technical means to actuate the slide piece.
Figure 8:
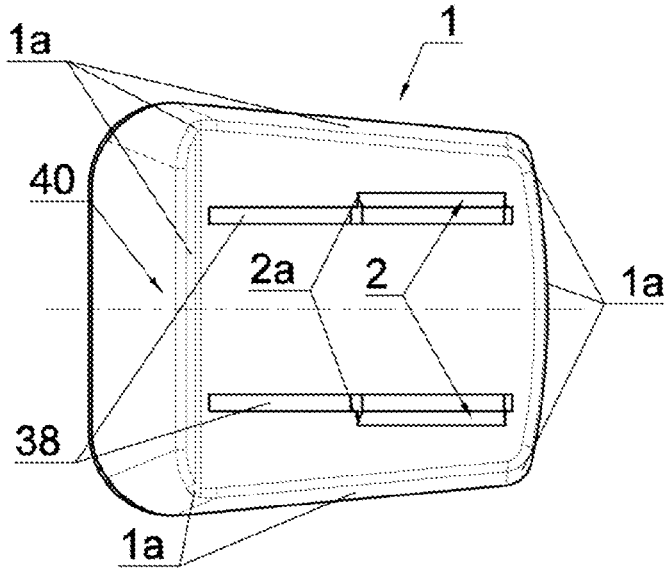
FIG. 8—shows the slide piece as in FIG. 7, in rectangular projection from the top.
Figure 9:
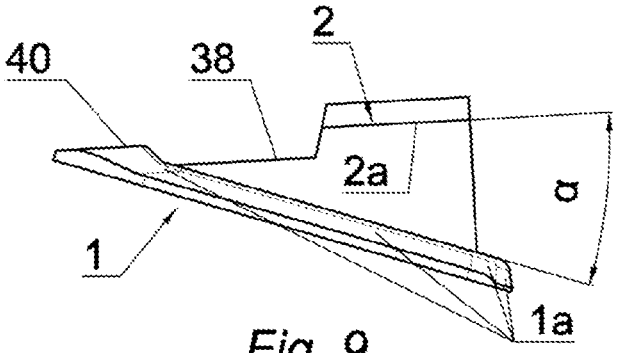
FIG. 9—presents the slide piece as in FIG. 7, in rectangular projection from the side.
Figure 10:
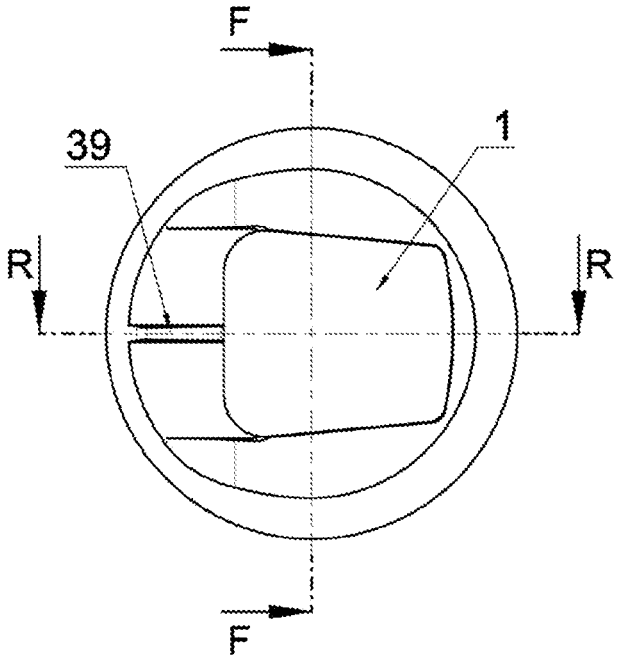
FIG. 10—depicts the lid with the slide piece, as in FIG. 7, in place, in rectangular projection from the bottom, in the closed position.
Figure 11:
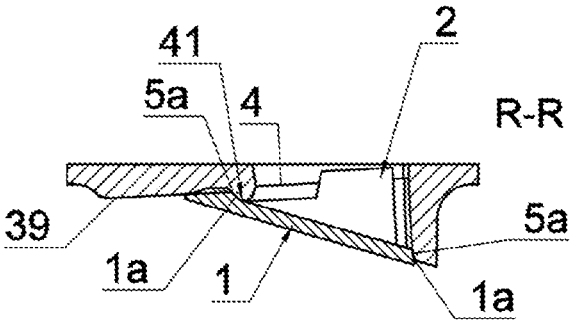
FIG. 11—shows the lid as in FIG. 10, in cross section along the R-R line.
Figure 12:
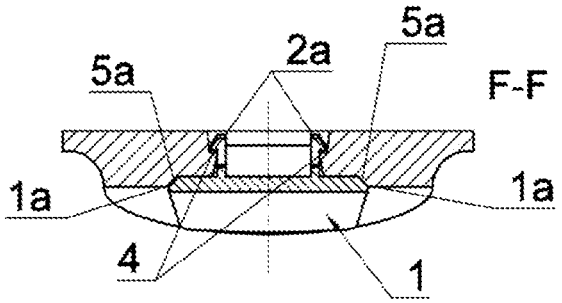
FIG. 12—presents the lid as in FIG. 10, in cross section along the F-F line.
Figure 13:
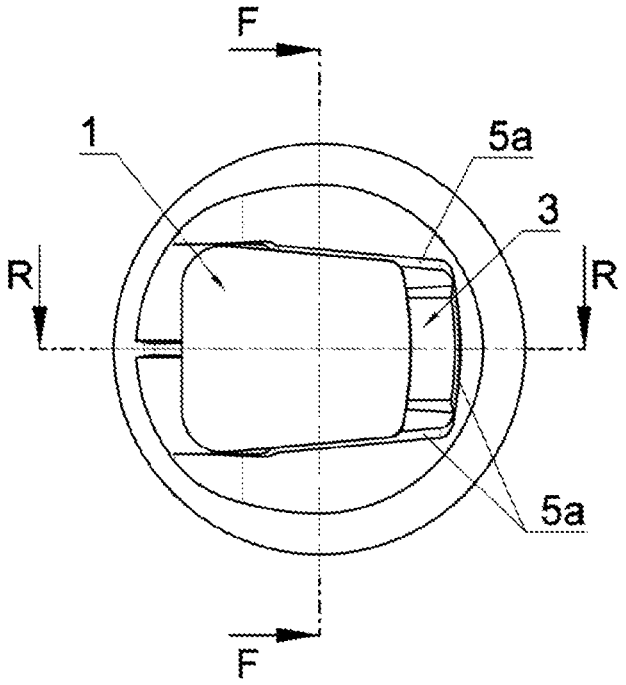
FIG. 13—depicts the lid with the slide piece, as in FIG. 7, in place, in rectangular projection from the bottom, in the open position.
Figure 14:
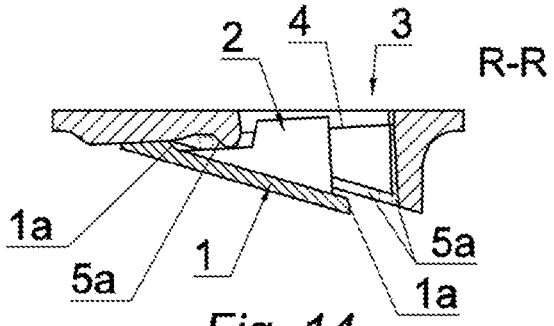
FIG. 14—shows the lid as in FIG. 13, in cross section along the R-R line.
Figure 15:
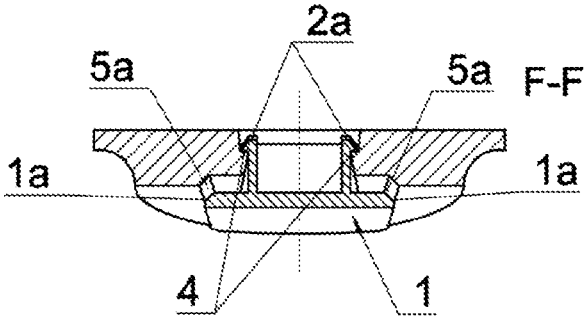
FIG. 15—presents the lid as in FIG. 13, in cross section along the F-F line.
Figure 16:
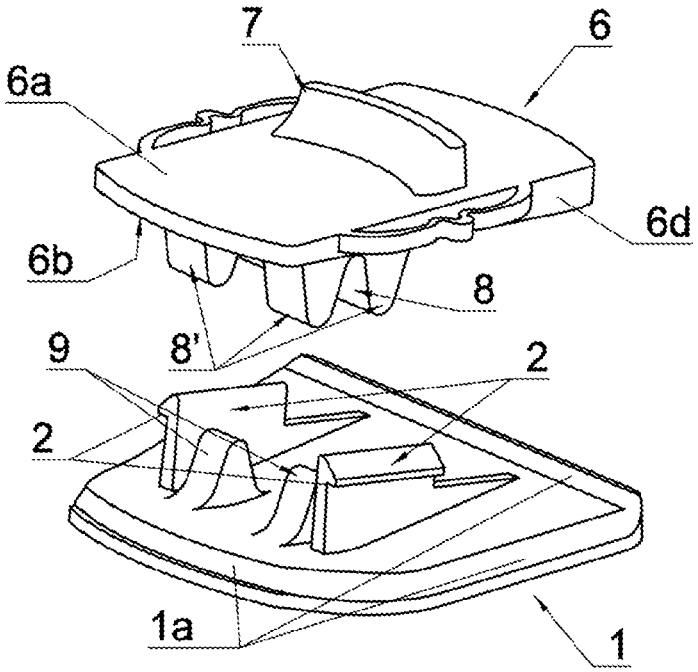
FIG. 16—depicts the slide piece and the matching slider in the first embodiment of the invention, in spatial view, in the position prior to the assembly.
Figure 17:
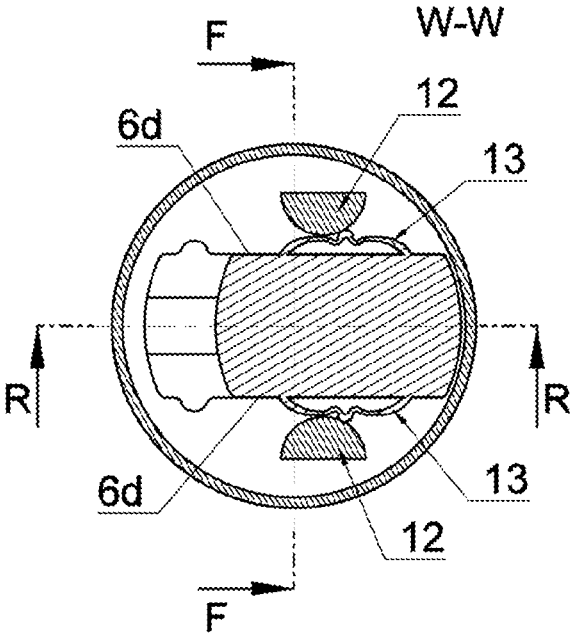
FIG. 17—presents the lid with the slide piece and slider, as in FIG. 16, in place, in the closed position, and the longitudinal W-W section.

An exemplary lid of a container, particularly a beverage container (FIG. 1 to FIG. 15) has an opening 3 for emptying the container. The opening 3 in the lid is fitted with guides 4 formed on two opposite walls 3*a* and with a slide piece 1 for opening and reclosing the said opening 3, with the width of the slide piece increasing in the direction in which the slide piece 1 shifts to the open position. Formed on the top surface of the slide piece 1 are two catches 2 fitted slidingly in the opening 3 on the said guides 4. Surfaces 2*a* of the catches 2 of the slide piece 1, which cooperate with the guides 4 of the opening 3 are inclined at an acute angle α, preferably falling in the range from 5° to 30°, most preferably from 10° to 20°, with respect to the top surface of the slide piece 1 positioned under the said surfaces 2*a* of the catches 2, with the slope in the direction in which the slide piece 1 shifts to the open position, i.e. to the position in which the opening is partially uncovered. Formed on the bottom surface of the lid, around the opening 3, is a socket 5 to accommodate the slide piece 1, the socket fitted along its circumference with profiled surfaces 5*a* to seal the contact between the slide piece 1 and the socket 5 when in the closed position, i.e. the position in which the opening is closed. The said sealing surfaces 5*a* match the profile of the circumferential surfaces 1*a* of the slide piece 1. Formed on the top surface of the slide piece 1 are two longitudinal distancing elements 38 and a transverse distancing profile element 40, while formed on the bottom surface of the slide piece, behind the socket 5 to accommodate the slide piece 1, is one longitudinal distancing element 39 and a transverse distancing element 41 formed along the transverse back wall 3*b*" of the opening 3. The profiled surfaces 5*a* which seal the slide piece 1 in the socket 5 positioned on the opposite sides along the socket 5, and the surfaces 1*a* matching them, positioned on the opposite sides along the slide piece 1 open out towards the bottom. During the uncovering of the opening 3 the slide piece 1 is moved towards the bottom with respect to the socket 5. In the course of shifting the slide piece 1, the longitudinal distancing elements 38 of the slide piece 1 cooperate with the transverse distancing element 41 formed along the transverse back wall 3*b*" of the opening 3, and the transverse distancing profile 40 of the slide piece 1 cooperates with the longitudinal distancing element 39 formed on the bottom surface of the lid behind the socket. On the top surface, the slide piece 1 is fitted with technical means for its shifting from the closed position to the open position and backwards, i.e. for opening and reclosing the opening 3, as described below in various exemplary embodiments.

Figure 18:
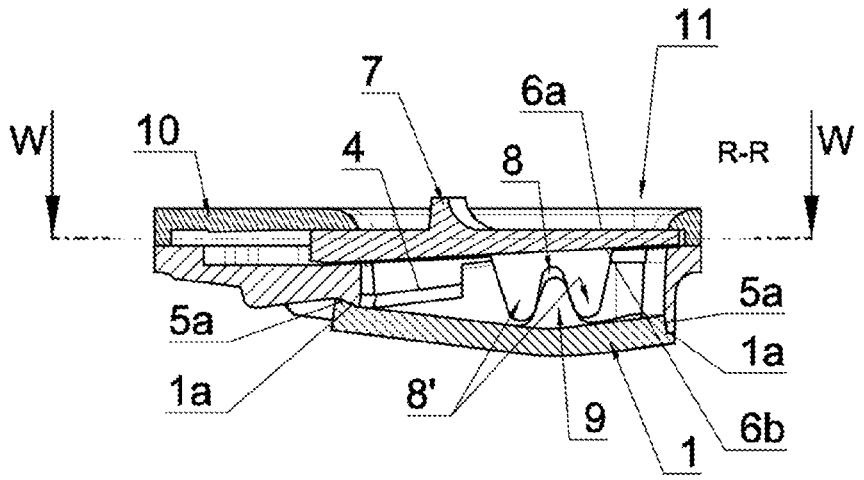
FIG. 18—shows the lid as in FIG. 17 with the cap, in cross section along the R-R line.
Figure 19:
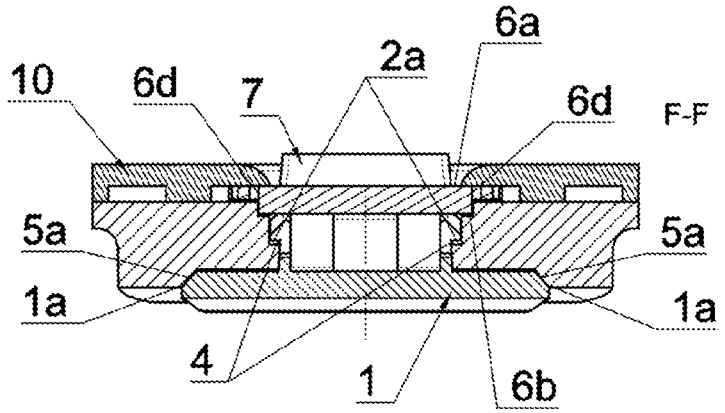
FIG. 19—depicts the lid as in FIG. 17 with the cap, in cross section along the F-F line.
Figure 20:
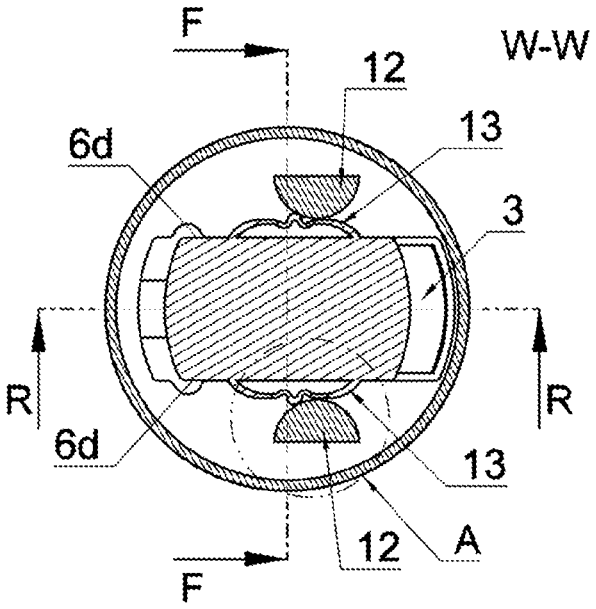
FIG. 20—presents the lid with the slide piece and the slider in place, as in FIG. 16, in the open position, in longitudinal W-W section.
Figure 21:
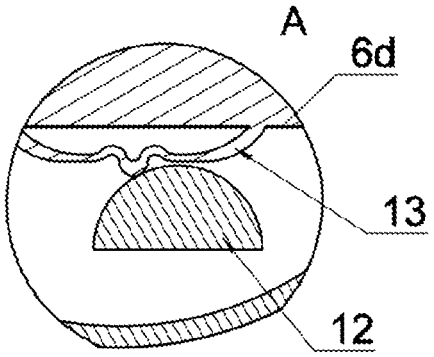
FIG. 21—depicts the detail as in FIG. 20.
Figure 22:
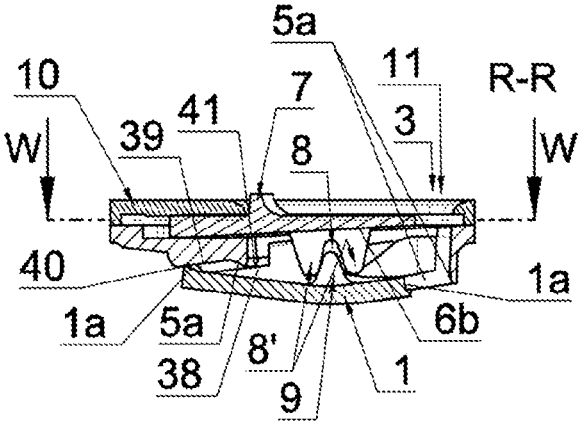
FIG. 22—shows the lid as in FIG. 20 with the cap, in cross section along the R-R line.
Figure 23:
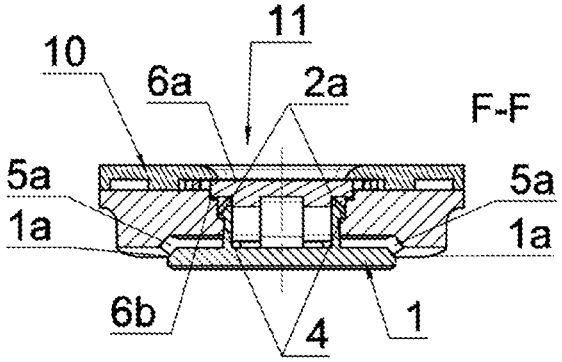
FIG. 23—presents the lid as in FIG. 20 with the cap, in cross section along the F-F line.
Figure 24:
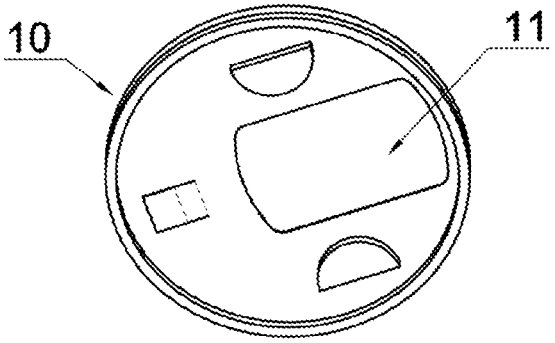
FIG. 24—depicts the cap in spatial view from the bottom.
Figure 25:
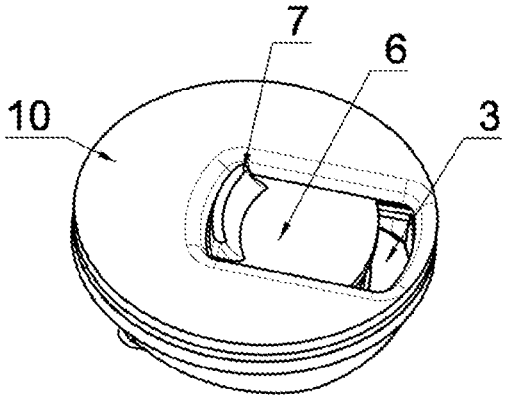
FIG. 25—shows the lid with the slide piece, slider, and cap in place, in the open position, in spatial view.
Figure 26:
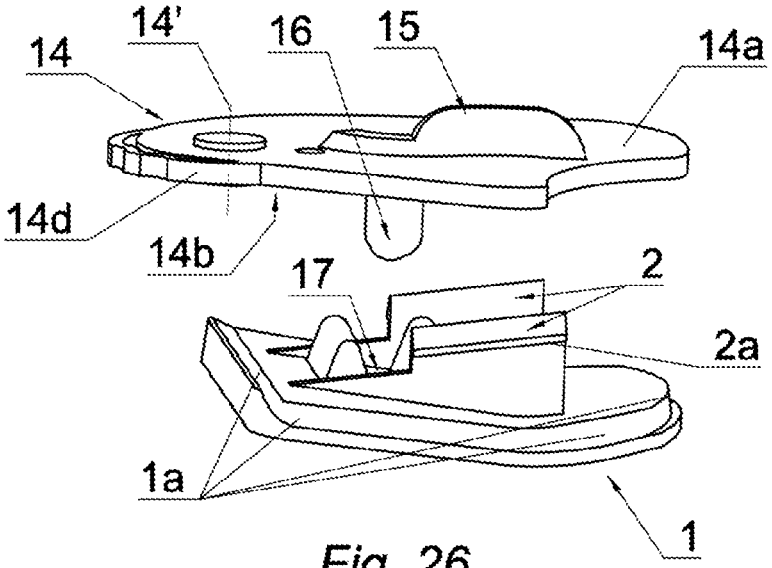
FIG. 26—presents the slide piece and the matching swivel tab in the second embodiment, in spatial view, in the position prior to the assembly.
Figure 27:
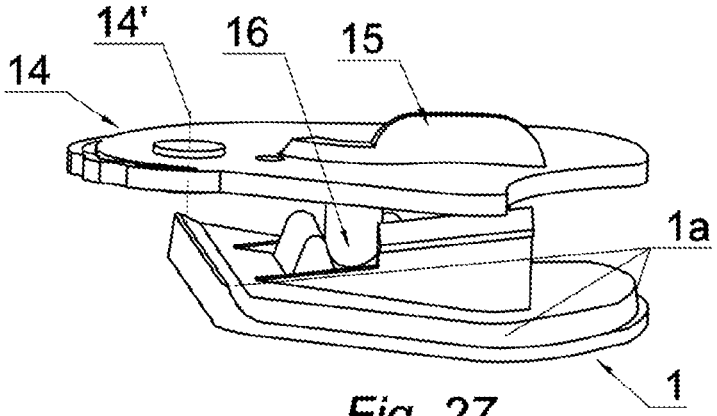
FIG. 27—depicts the slide piece with the swivel tab in place, in spatial view.
Figure 28:
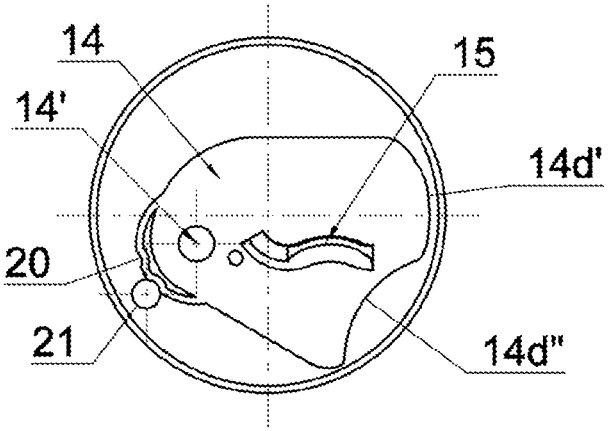
FIG. 28—shows the lid with the slide piece and the swivel tab in place, in rectangular projection from the top, in the closed position.

In the first exemplary embodiment (FIG. 16 to FIG. 25) the technical means for shifting the slide piece 1 from the closed position to the open position and backwards take the form of a slider 6 fitted over the opening 3 of the lid, the slider having the top surface 6*a* with a profile element 7 in the form of a projection or indentation to actuate the slider formed thereon, and further having the bottom surface 6*b* and longitudinal side surfaces 6*d*. Formed on the top surface of the slide piece 1 and correspondingly on the bottom surface 6*b* of the slider 6 is a pair of mutually coupling elements, namely a transverse groove 8 formed between the projections 8' formed on the bottom surface 6*b* of the slider 6 and transverse projections 9 formed on the top surface of the slide piece 1 which are placed in the said transverse groove 8 on the bottom surface 6*b* of the slider 6. The lid is fitted with a cap 10 featuring an opening 11 positioned over the opening 3 in the lid. Formed on the longitudinal side surfaces 6*d* of the slider 6 is a pair of resilient resistance elements 13 which cooperate with the pair of the elements 12 formed on the bottom surface of the cap 10. The resilient resistance elements 13 prevent uncontrolled shifting of the slider 6. When in the closed position (FIG. 18), the slider 6 covers the opening 3 in the lid. The profile 7 shaped on the top surface 6*a* of the slider 6 is used to actuate the slider 6 by overcoming the resistance on the resilient elements 13, whereupon the opening 3 in the lid gets uncovered (FIG. 22, FIG. 25) and the container can be emptied. When the slider 6 is shifted to uncover the opening 3 in the lid, the slide piece 1 shifts in the same direction as the slider 6 and moves down towards the inside of the container.

Figure 29:
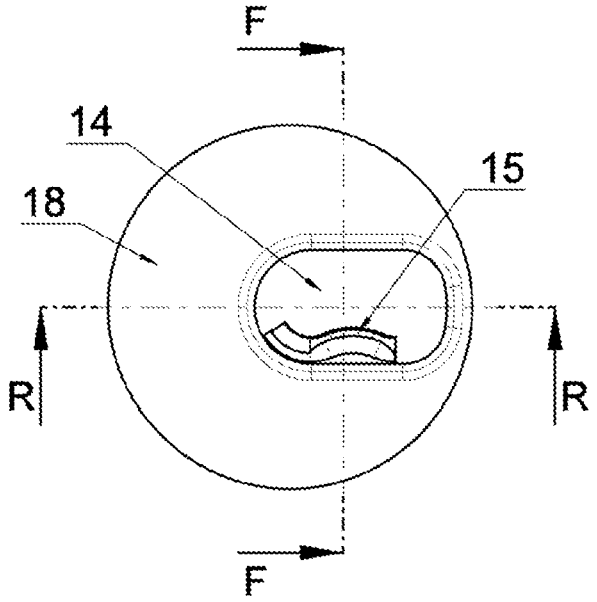
FIG. 29—presents the lid with the slide piece, swivel tab, and cap in place, in rectangular projection from the top, in the closed position.
Figure 30:
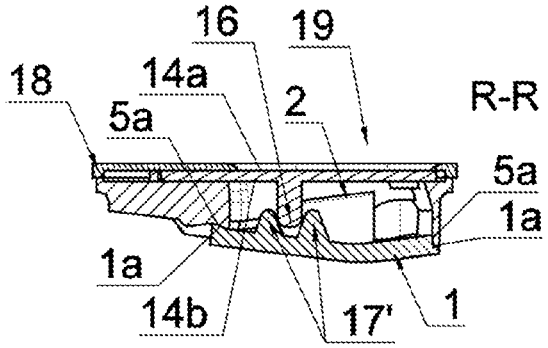
FIG. 30—depicts the lid as in FIG. 29, in cross section along the R-R line.
Figure 31:
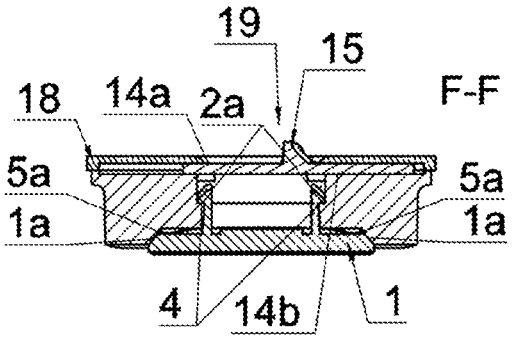
FIG. 31—shows the lid as in FIG. 29, in cross section along the F-F line.
Figure 32:
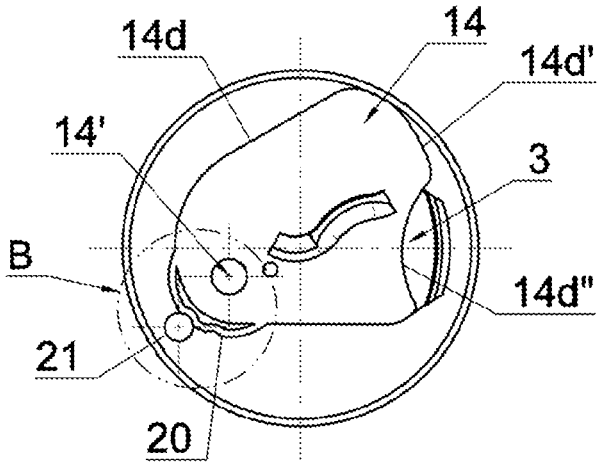
FIG. 32—presents the cover with the slide piece and swivel tab in place, in rectangular projection from the top, in the open position.
Figure 33:
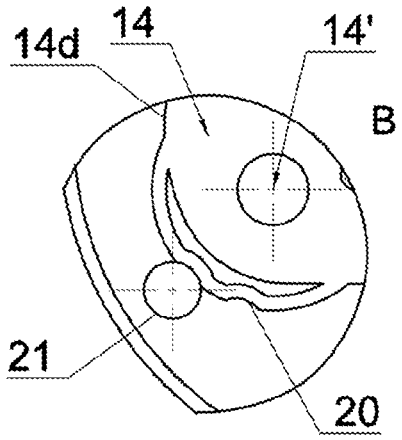
FIG. 33—depicts detail B as in FIG. 32.
Figure 34:
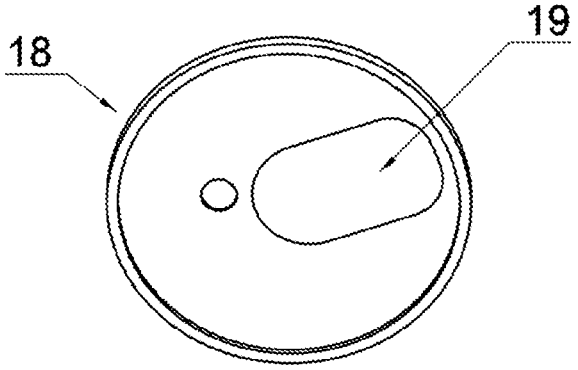
FIG. 34—shows the cap in spatial view from the bottom.
Figure 35:
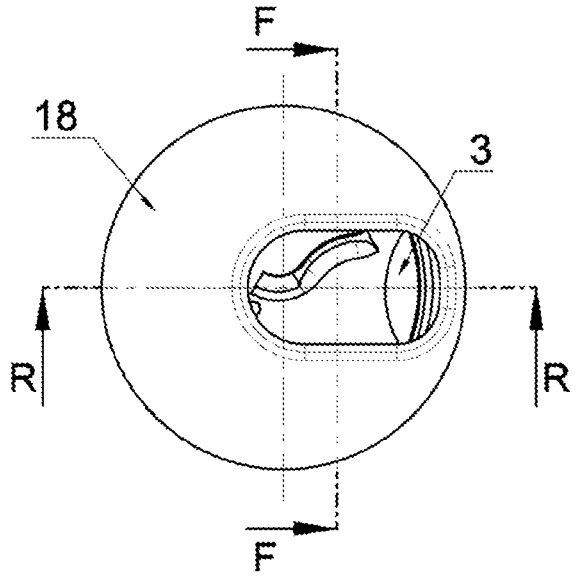
FIG. 35—presents the lid with the slide piece, swivel tab, and cap in place, in rectangular projection from the top, in the open position.
Figure 36:
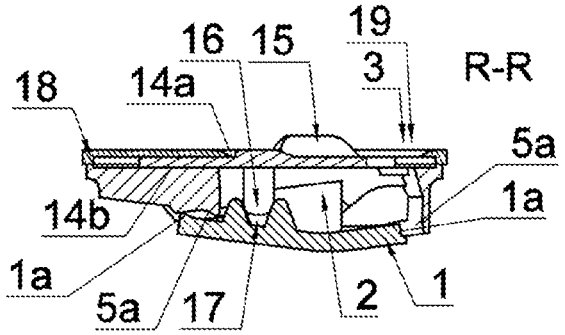
FIG. 36—depicts the lid as in FIG. 35, in cross-section along the R-R line.
Figure 37:
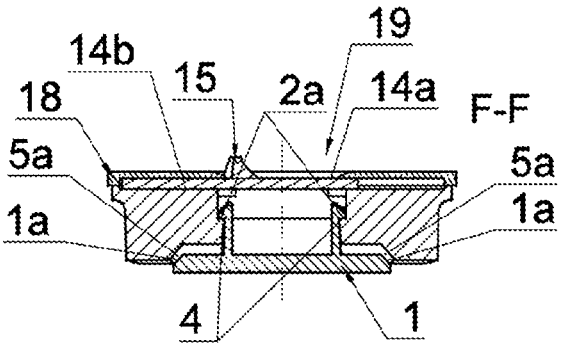
FIG. 37—shows the lid as in FIG. 35, in cross-section along the F-F line.
Figure 38:
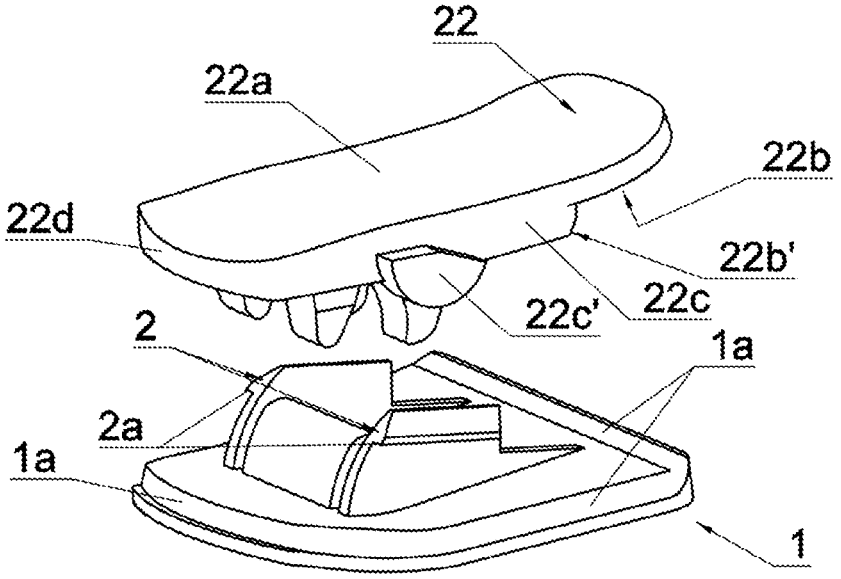
FIG. 38—presents the slide piece and the matching pull tab in the third embodiment, in spatial view, in the position prior to the assembly.
Figure 39:
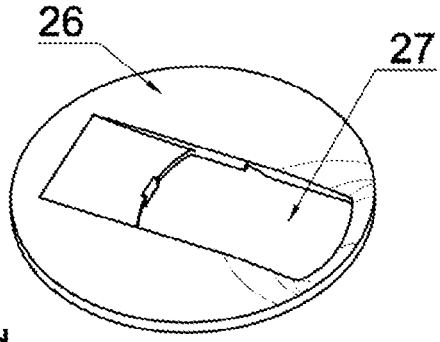
FIG. 39—depicts the cap in spatial view.
Figure 40:
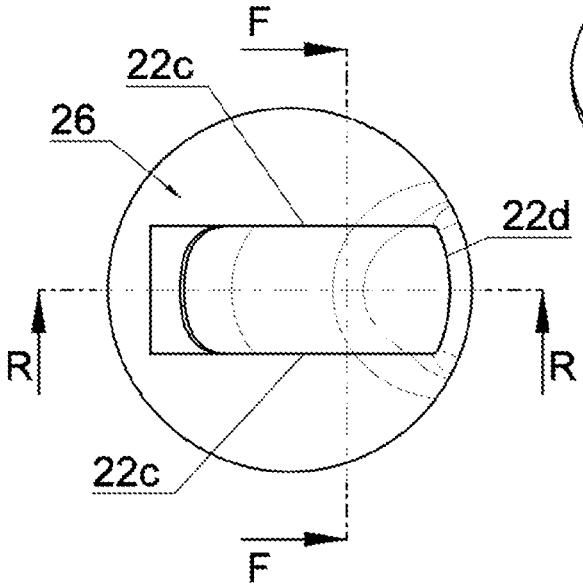
FIG. 40—presents the lid with the slide piece, pull tab, and cap in place, in rectangular projection from the top, in the closed position.
Figure 41:
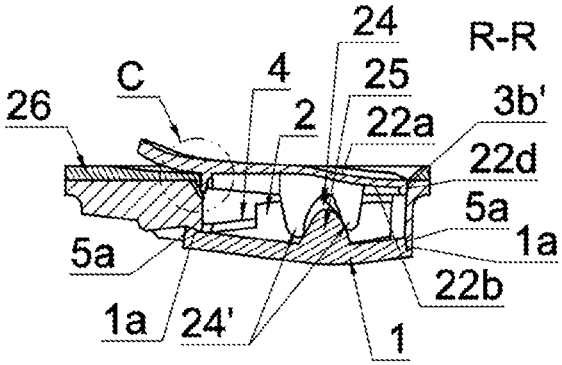
FIG. 41—shows the lid as in FIG. 40, in cross section along the R-R line.
Figure 42:
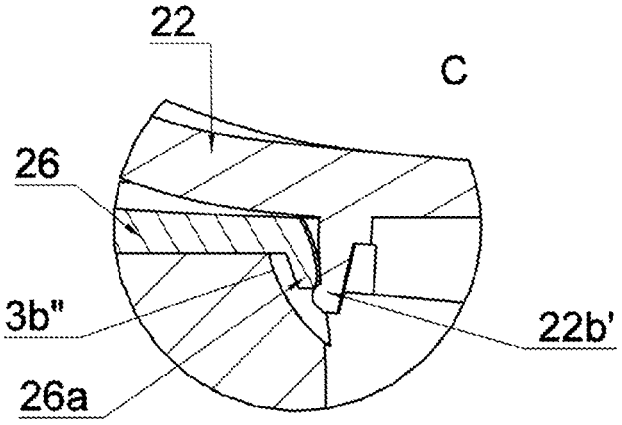
FIG. 42—depicts detail C, as in FIG. 41.
Figure 43:
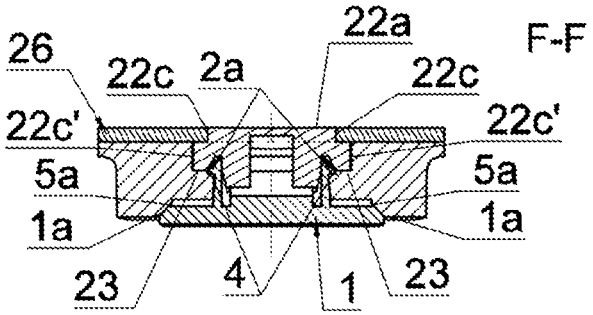
FIG. 43—presents the lid as in FIG. 40, in cross section along the F-F line.
Figure 44:
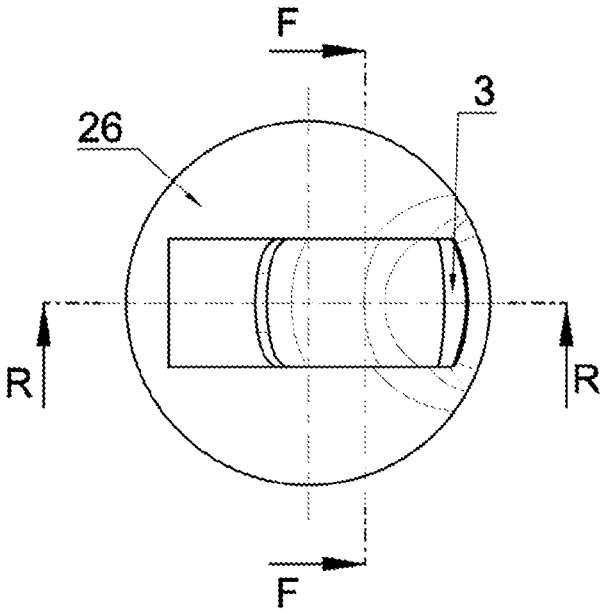
FIG. 44—shows the lid with the slide piece, pull tab, and cap in place, in rectangular projection from the top, in the open position.

In the second embodiment of the invention (FIG. 26 to FIG. 37) the technical means for shifting the slide piece 1 from the closed position to the open position and backwards take the form of a swivel tab 14 with vertical axis of rotation 14', fitted on the top surface of the lid over the opening 3, where the swivel tab 14 has the top surface 14*a* with a profile element 15, for example a radial projection, for actuating the swivel tab formed thereon, the bottom surface 14*b*, and the circumferential side surface 14*d*. The shape of the circumferential side surface 14*d*' of the swivel tab 14 on one side of the profile element 15 is convex and is designed to close the opening 3, while the shape of the circumferential side surface 14*d*" of the swivel tab 14 on the other side of the profile element 15 is concave and is designed to partially uncover the opening 3. Formed on the top surface of the slide piece 1 and correspondingly on the bottom surface 14*b* of the swivel tab 14 is a pair of mutually cooperating elements, with one of them taking the form of a driving pin 16 formed on the bottom surface of the swivel tab 14, and the other of a guiding groove 17 formed on the top surface of the slide piece 1 in between the projections 17'. The vertical axis of rotation 14' of the swivel tab 14 is placed on one of the sides of the plane of symmetry delimited in between the guides 4 of the opening 3, and the guiding groove 17 is formed transversely on the top surface of the slide piece 1. When the swivel tab 14 swivels, the said driving pin 16 moves, thus actuating the movement of the slide piece 1, where in the closed position the swivel tab 14 touches on the opening 3 in the lid with the element having the side circumferential surface 14*d*' which covers the opening 3 (FIG. 29), while in the open position the swivel tab 14 touches on the opening 3 in the lid with the element having the side circumferential surface 14*d*" which partially uncovers the opening 3 (FIG. 35). The lid is fitted with a cap 18 featuring an opening 19 positioned over the opening 3 in the lid. Formed on the side circumferential surface 14*d* of the swivel tab 14 is a resilient resistance element 20 which cooperates with the resistance element 21 formed on the top surface of the lid. During the swivel of the swivel tab 14 so as to uncover the opening 3 in the lid, the driving pin 16 moves in the groove 17, thus shifting the slide piece 1 on the guides 4 and uncovering the opening 3, at the same time moving the slide piece down towards the inside of the container.

In the third embodiment of the invention (FIG. 38 to FIG. 47), the technical means to shift the slide piece 1 from the closed position to the open position and backwards, i.e. to open and reclose the opening 3, take the form of a pull tab 22 having the bottom surface 22*b* with a resistance projection 22*b*' formed thereon, two longitudinal side surfaces 22*c*, formed on which is a pair of opposite side projections 22*c*' with arched edges, and a side transverse front surface 22*d* on one end of the pull tab. Formed on the top surface of the slide piece 1 and correspondingly on the bottom surface 22*b* of the pull tab 22 is a pair of mutually coupling elements in the form of a groove 24 formed on the bottom surface 22*b* of the pull tab 22, positioned in between the formed projections 24', and of the projection 25 formed on the top surface of the sliding piece 1 and placed in the said groove 24. Formed on the side longitudinal walls of the opening 3 in the lid are two opposite sockets 23 with the said side projections 22*c*' of the pull tab 22 rotatingly fitted therein. The lid is fitted with a cap 26 featuring an opening 27 positioned over the opening 3 in the lid, and a resistance element 26*a* positioned on the transverse back wall 3*b*" of the opening 3.

Figure 45:
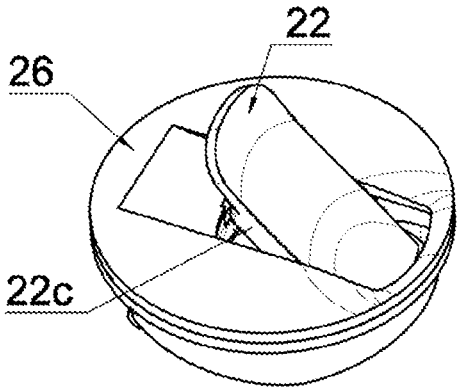
FIG. 45—depicts the lid with the slide piece, pull tab, and cap in place, in spatial view from the top, in the open position.
Figure 46:
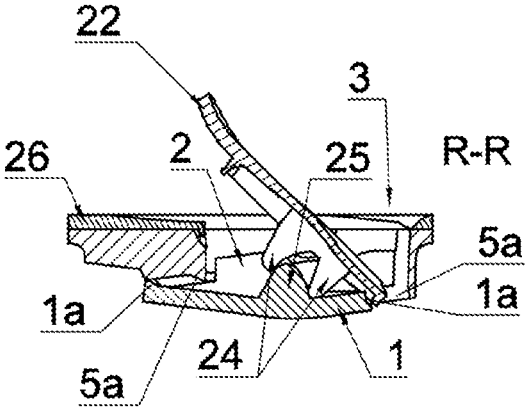
FIG. 46—shows the lid as in FIG. 44, in cross section along the R-R line.
Figure 47:
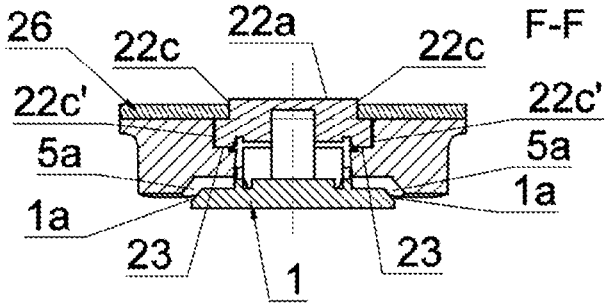
FIG. 47—presents the lid as in FIG. 44, in cross section along the F-F line.
Figure 48:
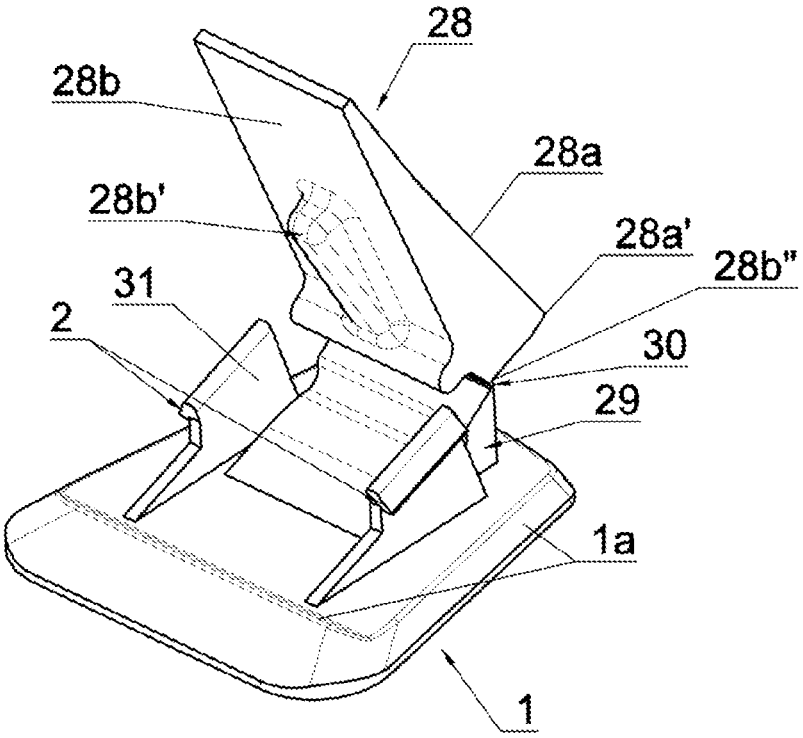
FIG. 48—depicts the slide piece with the pull tab lifted up, in the fourth embodiment, in spatial view.
Figure 49:
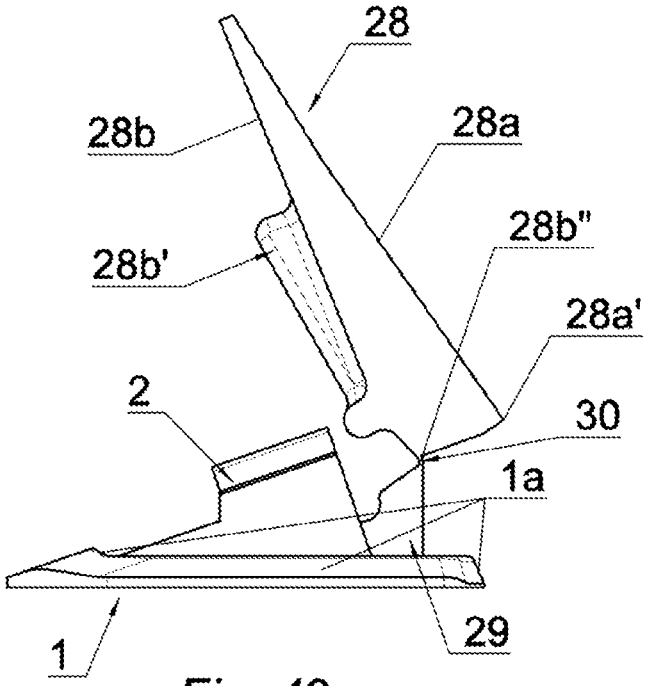
FIG. 49—presents the slide piece with the pull tab lifted up, in side view.
Figure 50:
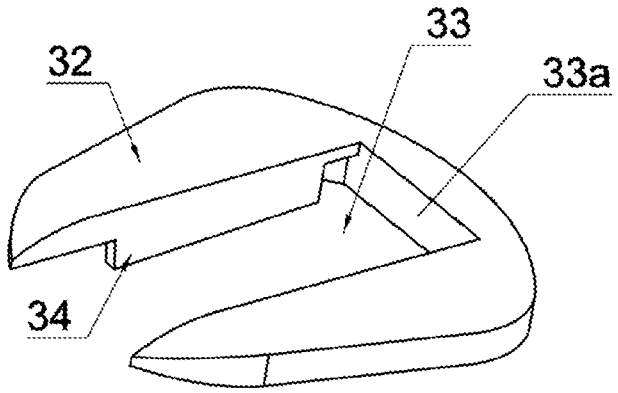
FIG. 50—shows the cap in spatial view from the top.
Figure 51:
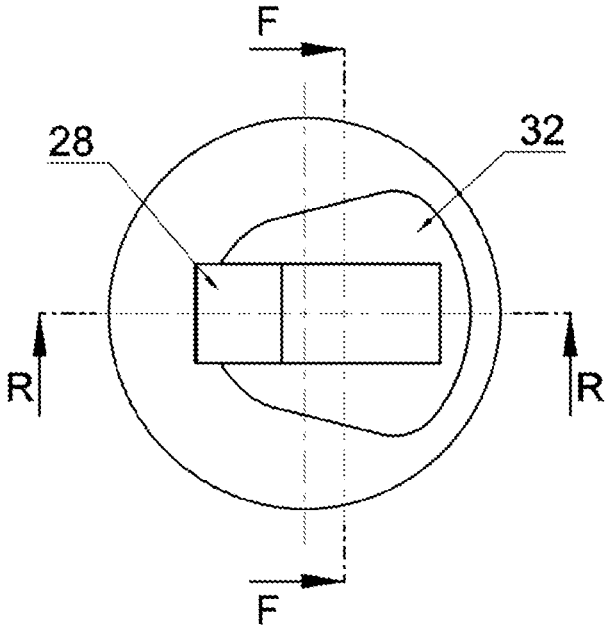
FIG. 51—depicts the lid with the slide piece, pull tab, and cap in place, in rectangular view from the top, in the closed position.

In the closed position the side transverse front surface 22*d* on one end of the pull tab 22 touches on the transverse front wall 3*b*' of the opening 3, and the other end of the pull tab 22 rests on the lid, with the said resistance projection 22*b*' of the pull tab 22 resting on the said resistance element 26*a* of the cap 26, which is placed on the opposite transverse back wall 3*b*" of the opening 3. To uncover the opening 3 the free end of the pull tab 22 should be lifted, thus shifting the slide piece 1 and moving it away from the socket 5 in the direction towards the inside of the container, while the opposite end of the pull tab 22 with the side transverse front surface 22*d* will move downwards and uncover the opening 3 (FIG. 45).

Figure 52:
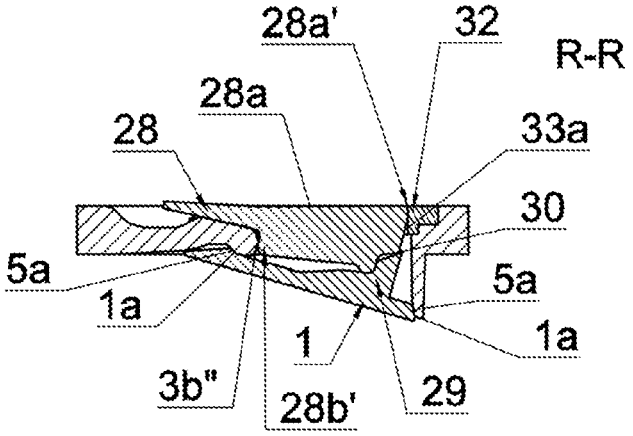
FIG. 52—shows the lid as in FIG. 51, in cross section along the R-R line.
Figure 53:
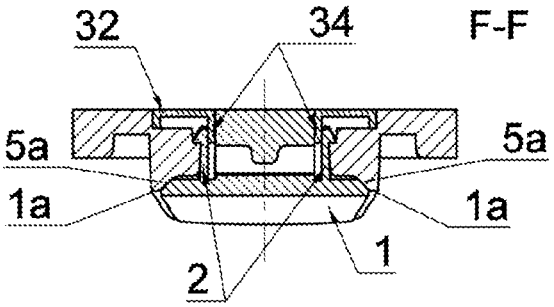
FIG. 53—presents the lid as in FIG. 51, in cross section along the F-F line.
Figure 54:
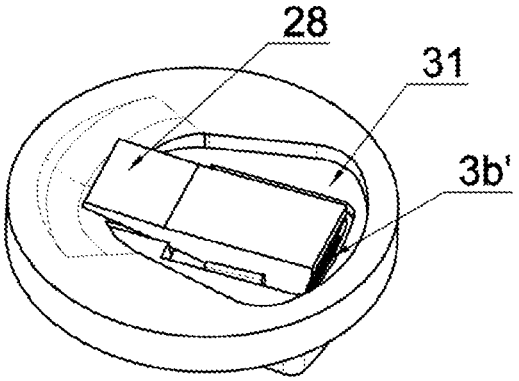
FIG. 54—shows the lid with the slide piece and pull tab in place, without the cap, in spatial view from the top, in the closed position.
Figure 55:
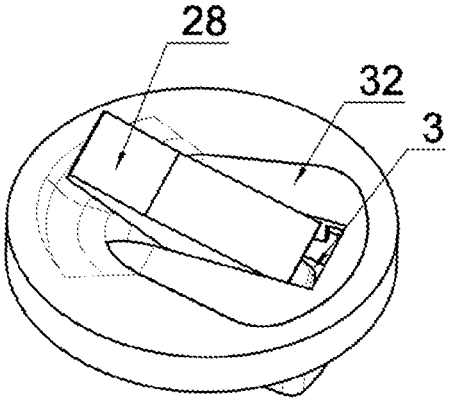
FIG. 55—depicts the lid with the slide piece, pull tab, and cap in place, in spatial view from the top, in the open position.
Figure 56:
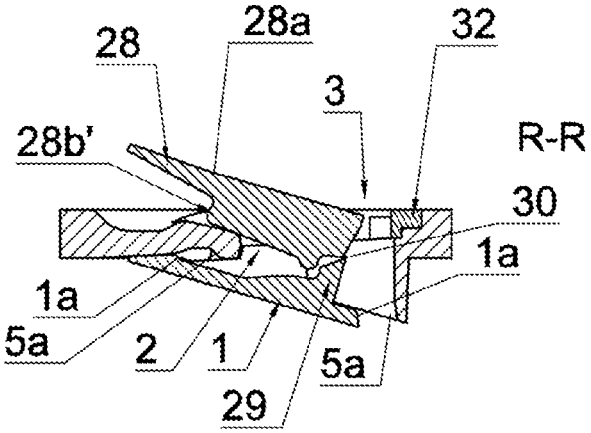
FIG. 56—presents the lid as in FIG. 55 in cross section along the R-R line—corresponding to FIG. 51.
Figure 57:
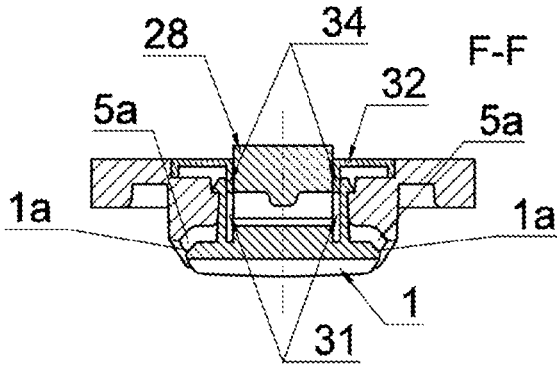
FIG. 57—depicts the lid as in FIG. 55 in cross section along the F-F line—corresponding to FIG. 51.
Figure 58:
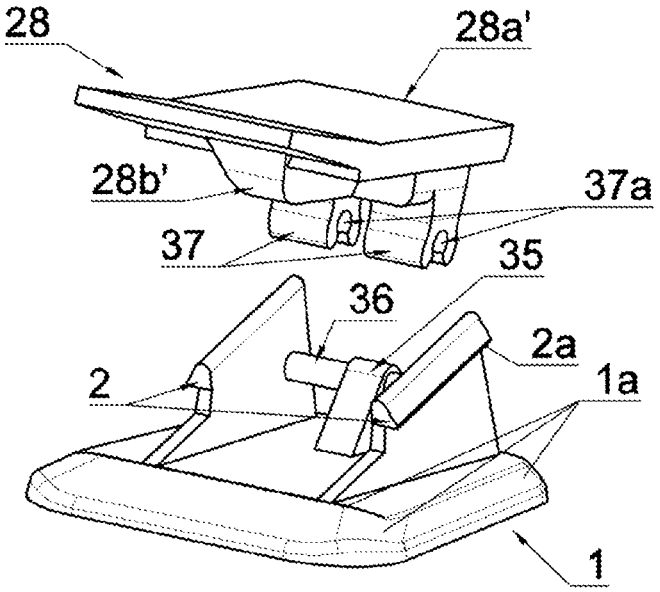
FIG. 58—shows the slide piece without the pull tab assembled thereon, in the fifth embodiment, in spatial view.
Figure 59:
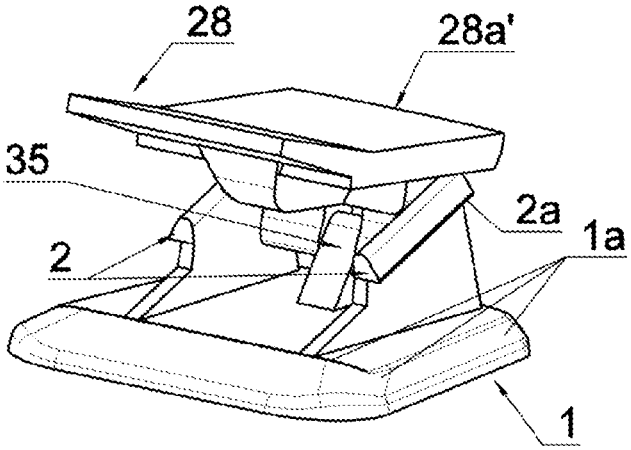
FIG. 59—presents the slide piece with the pull tab in place, in spatial view.
Figure 60:
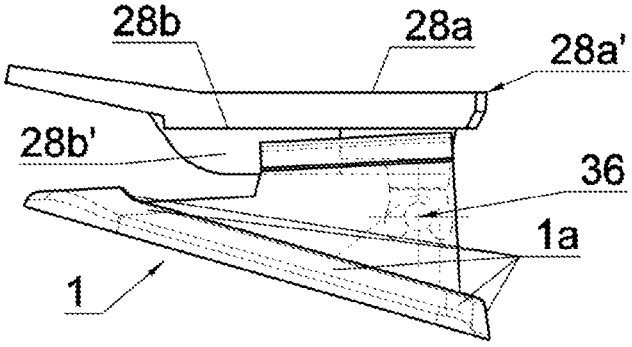
FIG. 60—depicts the slide piece with the pull tab in place, in the closed position, in side view.
Figure 61:
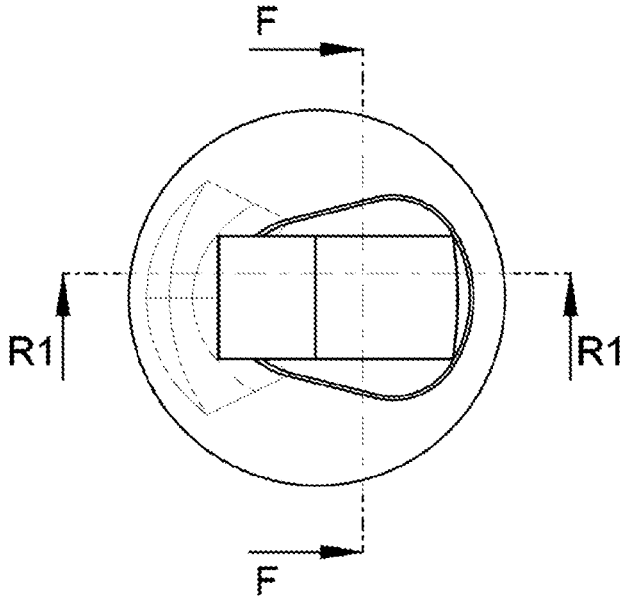
FIG. 61—shows the lid with the slide piece in place and the pull tab assembled thereon, in rectangular projection from the top, in the closed position.
Figure 62:
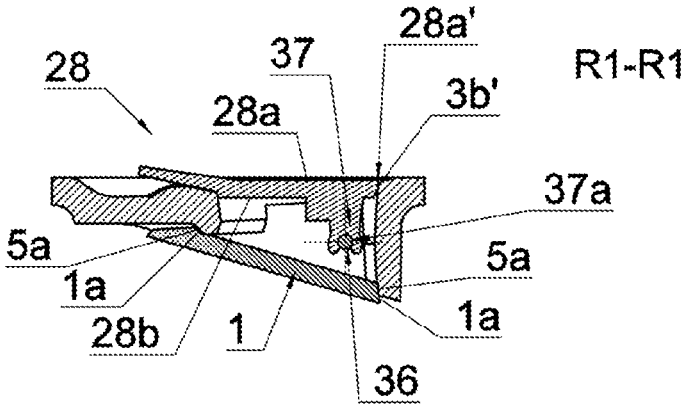
FIG. 62—presents the lid as in FIG. 61, in cross section along the R1-R1 line.
Figure 63:
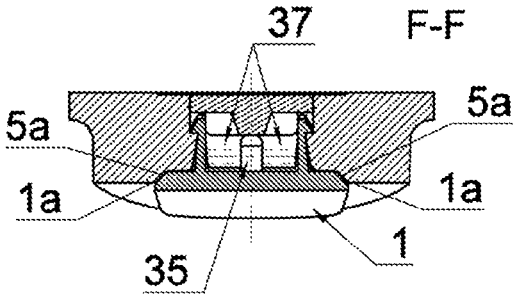
FIG. 63—depicts the lid as in FIG. 61, in cross section along the F-F line.
Figure 64:
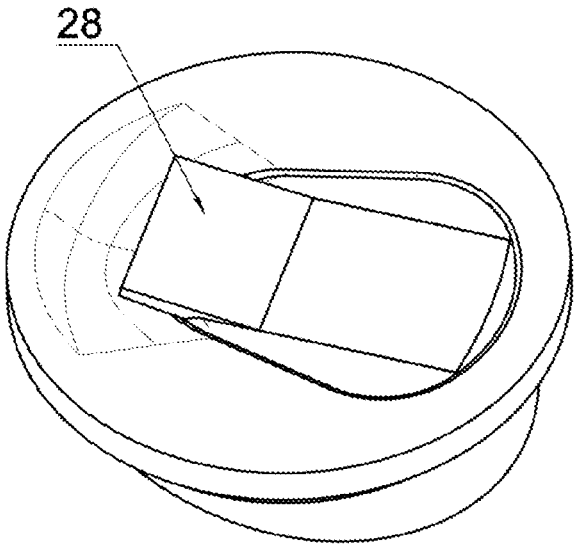
FIG. 64—shows the lid with the slide piece in place and the pull tab assembled thereon in spatial view from the top, in the closed position.
Figure 65:
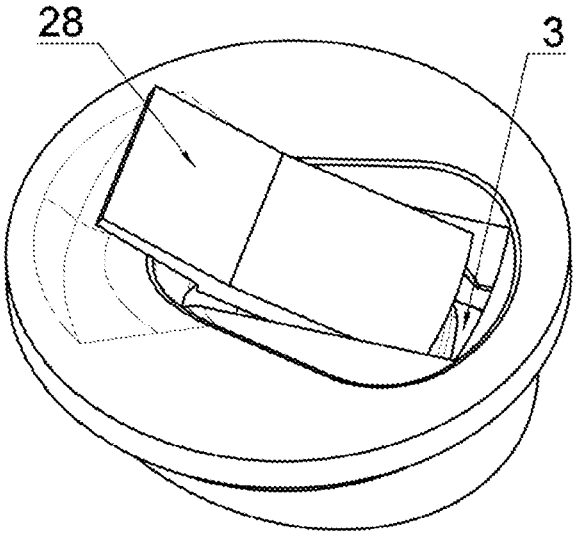
FIG. 65—depicts the lid with the slide piece in place and the pull tab; assembled thereon, in spatial view from the top, in the open position.
Figure 66:
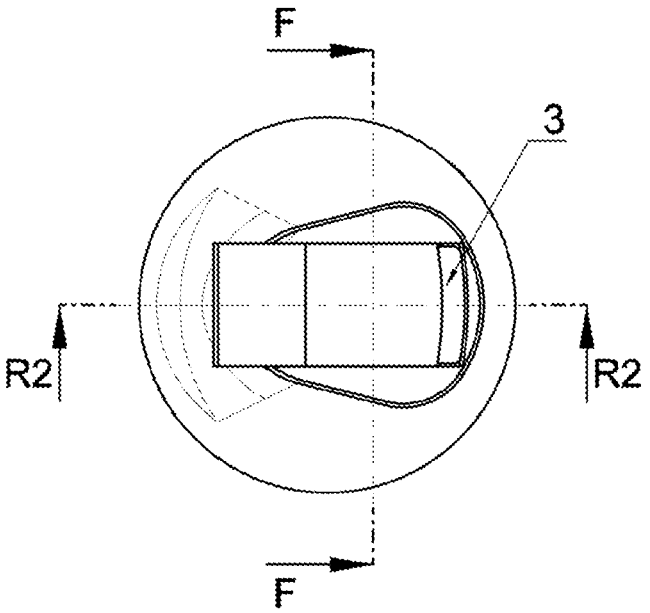
FIG. 66—presents the lid with the slide piece in place and the pull tab and the cap assembled thereon, in rectangular projection from the top, in the open position.

In the fourth embodiment of the invention (FIG. 48 to FIG. 57) the technical means for shifting the slide piece 1 take the form of a pull tab 28 having the top surface 28*a* with a top transverse edge 28*a*', and the bottom surface 28*b* with a projection 28*b*' and a bottom transverse edge 28*b*". Formed on the top surface of the slide piece 1 is a protruding element 29, connected to which via a membrane hinge 30 is the bottom edge 28*b*" of the surface 28*b* of the pull tab 28. The lid is fitted with a socket 31 to accommodate the cap 32. The cap 32 features an opening 33 with a transverse wall 33*a*, and formed on the bottom side of the cap are longitudinal projections 34. The cap 32 is arranged in the socket 31 of the lid so that the opening 33 is positioned over the opening 3 in the lid, the longitudinal projections 34 of the cap contact the opposite internal side walls of the catches 2, and the transverse wall 33*a* of the opening 33 in the cap touches on the transverse front wall 3*b*' of the opening 3 in the lid. The cap 32 protects the membrane hinge 30 against damage and stabilises the position of the catches 2 in the guides 4 with projections 34. In the closed position the top transverse edge 28*a*' touches on the transverse wall 33*a* of the opening 33 in the cap 32, and the projection 28*b*' rests on the transverse back wall 3*b*" of the opening 3 in the lid (FIG. 52). To uncover the opening 3 the pull tab 28 should be lifted, in effect of which the top transverse edge 28*a*' of the pull tab 28 will cooperate with the transverse wall 33*a* of the opening 33 in the cap 32, thus initiating the shifting of the slide piece 1, the movement continued by pulling the pull tab 28, which results in the shifting of the slide piece 1 to the open position, while moving the slide piece away from the socket 5 in the direction towards the inside of the container (FIG. 56).

Figure 67:
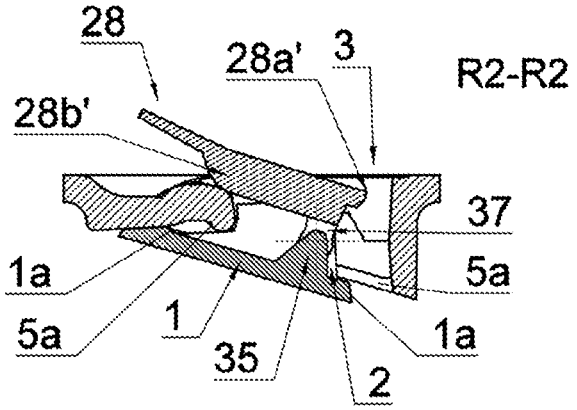
FIG. 67—shows the lid as in FIG. 66, in cross section along the R2-R2 line.
Figure 68:
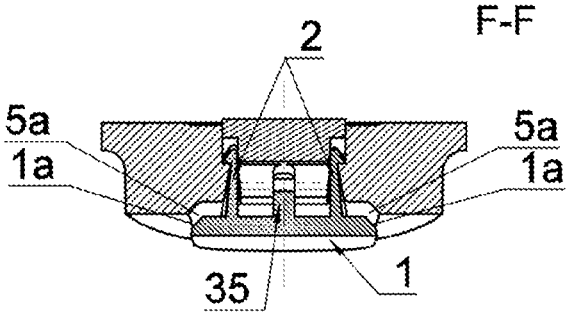
FIG. 68—depicts the lid as in FIG. 66, in cross section along the F-F line.

In the fifth exemplary embodiment of the invention (FIG. 58 to FIG. 68) the lid differs from the lid described in the fourth exemplary embodiment in that formed on the top surface of the slide piece 1 in between the catches 2 is a projection 35 so that formed between each catch 2 and the said projection 35 is a transverse rod 36, and formed on the bottom surface 28*b* of the pull tab 28 are two arms 37 ending with sockets 37*a*, the arms rotatingly fitted on the said rods 36. The lid has no cap. To uncover the opening 3, the pull tab 28 should be lifted, as in exemplary embodiment four, in effect of which the top transverse edge 28*a*' of the pull tab 28 will cooperate with the transverse front wall 3*b*' of the opening 3 in the lid, thus initiating the shifting of the slide piece 1, the movement continued by pulling the pull tab 28, which results in the shifting of the slide piece 1 to the open position, while moving it away from the socket 5 in the direction towards the inside of the container (FIG. 67)

In all exemplary embodiments the profile sealing surfaces 5*a* along the circumference of the socket 5 to accommodate the slide piece 1 are fitted with a sealing element.

In all exemplary embodiments the lid is made of plastic.

The structure of the lid according to the invention enables various configurations of the mechanism actuating the process of opening and reclosing, which are not exhausted by the exemplary embodiments.

LIST OF NUMERICAL REFERENCES

1—slide piece
1*a*—circumferential surfaces of the slide piece
2—slide piece catches
2*a*—surfaces of the slide piece catches which cooperate with the guides on the walls of the opening in the lid
3—opening in the lid
3*a*—longitudinal opposite walls of the opening
3*b*'—transverse front wall of the opening in the lid
3*b*"—transverse back wall of the opening in the lid
4—guides on the longitudinal walls of the opening in the lid
5—socket to accommodate the slide piece, formed on the bottom surface of the lid
5*a*—circumferential profiled surfaces of the socket for the slide piece
α angle between the surfaces of the slide piece catches cooperating with the guides and the top surface of the slide piece positioned under the said surfaces
6—slider
6*a*—top surface of the slider
6*b*—bottom surface of the slider
6*d*—side longitudinal surfaces of the slider
7—profile on the top surface of the slider
8—groove in the bottom surface of the slider
8'—projections on the bottom surface of the slider which form the groove 8
9—projections formed on the top surface of the slide piece
10—lid cap
11—opening in the lid cap
12—elements of the cap which cooperate with the resilient resistance elements of the slider
13—resilient resistance elements of the slider formed on the side longitudinal surfaces
14—swivel tab
14'—swivel tab axis
14*a*—top surface of the swivel tab
14*b*—bottom surface of the swivel tab
14*d*—side circumferential surface of the swivel tab
14*d*'—fragment of the side circumferential surface of the swivel tab which covers the opening
14*d*"—fragment of the side circumferential surface of the swivel tab which uncovers the opening
15—profile on the top surface of the swivel tab
16—driving pin
17—groove guiding the driving pin
17'—projections which form the groove 17
18—lid cap
19—opening in the lid cap
20—resistance element on the side circumferential surface of the swivel tab
21—resistance element on the top surface of the lid which cooperates with the resistance element on the side circumferential surface of the swivel tab

22—pull tab
22*a*—top surface of the pull tab
22*b*—bottom surface of the pull tab
22*b*'—resistance projection on the bottom surface of the pull tab
22*c*—two longitudinal side surfaces of the pull tab
22*c*'—two projections with arched edges, formed on longitudinal side surfaces of the pull tab
22*d*—side front surface of the pull tab
23—sockets for the projections formed on the side longitudinal walls of the opening in the lid
24—groove formed on the bottom surface of the pull tab
24'—projections which form the groove 24
25—projection formed on the top surface of the slide piece
26—lid cap
26*a*—resistance element of the cap for the pull tab
27—opening in the cap
28—pull tab
28*a*—top surface of the pull tab
28*a*'—top transverse edge of the top surface of the pull tab
28*b*—bottom surface of the pull tab
28*b*'—projection on the bottom surface of the pull tab
28*b*"—bottom transverse edge of the bottom surface of the pull tab
29—protruding element on the top surface of the slide piece
30—membrane hinge of the pull tab
31—socket in the lid to accommodate the cap
32—lid cap
33—opening in the cap
34—longitudinal projections on the bottom side of the cap
35—two projections on the top surface of the slide piece
36—transverse rod
37—two arms on the bottom surface of the pull tab
37*a*—sockets of the arms formed on the bottom surface of the pull tab
38—longitudinal distancing element formed on the top surface of the slide piece
39—longitudinal distancing element formed on the bottom surface of the lid behind the socket
40—transverse distancing profile formed on the top surface of the slide piece
41—transverse distancing profile formed along the transverse back wall of the opening

The invention claimed is:

1. A lid of a container, particularly beverage container, comprising an opening for emptying the container, fitted with guides formed on two opposite walls and with a slide piece for opening and reclosing the said opening, wherein there are two catches formed on the top surface of the slide piece, the catches fitted slidingly in the opening on the said guides, and wherein the slide piece is fitted with technical means for shifting the slide piece from the closed position to the open position and backwards, wherein the surfaces (2*a*) of the catches (2) of the slide piece (1) which cooperate with the guides (4) are inclined at an acute angle (α) with respect to the top surface of the slide piece (1) positioned under the said surfaces (2*a*) of the catches (2), with the slope in the direction in which the slide piece (1) shifts to the open position, and where formed on the bottom side of the lid around the opening (3) is a socket (5) for the slide piece (1) with profiled surfaces (5*a*) to seal the slide piece (1) when in the socket (5) in the closed position formed around its circumference, where the profiled surfaces (5*a*) match the profile of the circumferential surfaces (1*a*) of the slide piece (1), and wherein in the process of uncovering the opening (3) the slide piece (1) is moved downwards with respect to the socket (5).

2. The lid according to claim 1, wherein the width of the slide piece (1) increases in the direction in which the slide piece (1) moves to the open position.

3. The lid according to claim 1, wherein the angle (α) of inclination of the surfaces (2*a*) of the catches (2) of the slide piece (1) with respect to the top surface of the slide piece (1) positioned under the said surfaces (2*a*) of the catches (2) ranges from 5° to 30°, preferably from 10° to 20°.

4. The lid according to claim 1, wherein formed on the top surface of the slide piece (1) is at least one longitudinal distancing element (38) and a transverse distancing profile element (40), and formed on the bottom side of the lid behind the socket (5) to accommodate the slide piece (1) is at least one longitudinal distancing element (39) and a transverse distancing element (41) formed along the transverse back wall (3*b*") of the opening (3).

5. The lid according to claim 1, wherein the profile surfaces (5*a*) which seal the slide piece (1) in its socket (5) are positioned on opposite sides along the socket (5), and the surfaces (1*a*) matching them, positioned on opposite sides along the slide piece (1) open out towards the bottom.

6. The lid according to claim 5, characterised in that profiled sealing surfaces (5*a*) along the circumference of the socket (5) for the slide piece (1) and or the circumferential profiled surfaces (1*a*) of the slide piece (1) are fitted with a sealing element.

7. The lid according to claim 1, wherein the technical means for shifting the slide piece (1) from the closed position to the open position and backwards take the form of a slider (6) fitted on the top side of the lid over the opening (3), the slider having the top surface (6*a*) with a profile element (7) to actuate the slider formed thereon, and further having the bottom surface (6*b*) and longitudinal side surfaces (6*d*), where formed on the top surface of the slide piece (1) and correspondingly on the bottom surface (6*b*) of the slider (6) is at least one pair of mutually coupling elements (8, 9), and where the lid is fitted with a cap (10) featuring an opening (11) positioned over the opening (3) in the lid.

8. The lid according to claim 7, wherein a transverse groove (8) and transverse projection (9) placed in the said groove (8) constitute the pair of mutually coupling elements (8, 9) formed on the top surface of the slide piece (1) and correspondingly on the bottom surface (6*b*) of the slider (6).

9. The lid according to claim 7, wherein formed on the longitudinal side surfaces (6*d*) of the slider (6) is a pair of resilient resistance elements (13), where on the top surface of the lid (3) and/or bottom surface of the cap (10) there are resistance elements (12) which cooperate with the said resilient resistance elements (13) of the slider (6).

10. The lid according to claim 1, wherein the technical means for shifting the slide piece (1) from the closed position to the open position and backwards take the form of a swivel tab (14) with vertical axis of rotation (14'), fitted on the top surface of the lid over the opening (3), where the slide piece has the top surface (14*a*) with a profile element (15) for actuating the swivel tab formed thereon, the bottom surface (14*b*), and the circumferential side surface (14*d*), and where the shape of the circumferential side surface (14*d*') of the swivel tab (14) on one side of the profile element (15) is designed to close the opening (3), while the shape of the circumferential side surface (14*d*") of the swivel tab (14) on the other side of the profile element (15) is designed to uncover the opening (3), whereas formed on the top surface of the slide piece (1) and correspondingly on the bottom surface (14*b*) of the swivel tab (14) is a pair of mutually cooperating elements, with one of them taking the form of a driving pin (16) and the other of a guiding groove (17) in which the said driving pin (16) moves during the swivel of the swivel tab (14), thus actuating the movement of the slide piece (1), where in the closed position the swivel tab (14) touches on the opening (3) in the lid with the element having the side circumferential surface (14*d*') which closes the opening (3), while in the open position the swivel tab (14) touches on the opening (3) with the element having the side circumferential surface (14*d*") which uncovers the opening (3), and where the lid is fitted with a cap (18) featuring an opening (19) positioned over the opening (3) in the lid.

11. The lid according to claim 10, wherein formed on the side circumferential surface (14*d*) of the swivel tab (14) is a resistance element (20) which cooperates with the resistance element (21) formed on the top surface of the lid and/or on the bottom surface of the cap (18), where at least one of those elements (21, 21) is resilient.

12. The lid according to claim 10, wherein the vertical axis of rotation (14') of the swivel tab (14) is placed on one of the sides of the plane of symmetry delimited in between the guides (4) formed on two opposite walls of the opening (3).

13. The lid according to claim 1, wherein the technical means to shift the slide piece (1) from the closed position to the open position and backwards take the form of a pull tab (22) having the bottom surface (22*b*) with a resistance projection (22*b*') formed thereon, two longitudinal side surfaces (22*c*), formed on which is a pair of opposite side projections (22*c*') with arched edges, and a side transverse front surface (22*d*) on one end of the pull tab, where formed on the top surface of the slide piece (1) and correspondingly on the bottom surface (22*b*) of the pull tab (22) is at least one pair of mutually coupling elements (24, 25), and formed on the side longitudinal walls (3*a*) of the opening (3) in the lid are two sockets (23) with the said side projections (22*c*') of the pull tab (22) rotatingly fitted therein, and where in the closed position the side transverse front surface (22*d*) on the one end of the pull tab (22) touches on the transverse front wall (3*b*') of the opening (3), and the other end of the pull tab (22) rests on the lid, with the said resistance projection (22*b*') in the pull tab (22) resting on the opposite transverse back wall (3*b*") of the opening (3).

14. The lid according to claim 13, wherein a transverse groove (24) and transverse projection (25) placed in the said groove (24) constitute the pair of mutually coupling elements (24, 25) formed on the top surface of the slide piece (1) and correspondingly on the bottom surface (22*b*) of the pull tab (22).

15. The lid according to claim 13, wherein the lid is fitted with a cap (26) featuring an opening (27) positioned over the opening (3) in the lid, and a resistance element (26*a*) positioned on the transverse back wall (3*b*") of the opening (3).

16. The lid according to claim 1, wherein the technical means for shifting the slide piece (1) take the form of a pull tab (28) having the top surface (28*a*) with a top transverse edge (28*a*'), and the bottom surface (28*b*) with a projection (28*b*') and a bottom edge (28*b*"), where in the closed position the top transverse edge (28') touches on the transverse front wall (3*b*') of the opening (3) and the said projection (28*b*') of the pull tab rests on the opposite transverse back wall (3*b*") of the opening (3), and where the pull tab (28) is rotatingly connected to the slide piece (1) with its bottom surface (28*b*), on the side of the said bottom edge (28*b*").

17. The lid according to claim 16, wherein formed on the top surface of the slide piece (1) is a protruding element (29), connected to which via a membrane hinge (3) is the bottom edge (28*b*") of the surface (28*b*) of the pull tab (28).

18. The lid according to claim 17, wherein the lid is fitted with a cap (32) with the opening (33) positioned over the opening (3) in the lid, and formed on the bottom side of the cap (32) there are longitudinal projections (34) which contact the opposite internal side walls of the catches (2).

19. The lid according to claim 16, wherein there is at least one transverse rod (36) formed on the top surface of the slide piece (1) in between the catches (2), and formed on the bottom surface (28*b*) of the pull tab (28) there is at least one arm (37) ending with a socket (37*a*), the arm rotatingly fitted on the said rod (36).

20. The lid according to claim 1, wherein the lid is made of plastic.

* * * * *